US006240870B1

(12) United States Patent
Komura et al.

(10) Patent No.: US 6,240,870 B1
(45) **Date of Patent: *Jun. 5, 2001**

(54) ANCHOR

(75) Inventors: Adolfo Tsuyoshi Komura, Macae; Gustavo Adolfo Villela de Castro, Rio de Janerio, both of (BR)

(73) Assignee: Petroleo Brasileiro S.A. - Petrobras (BR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/481,711

(22) Filed: Jan. 12, 2000

(30) Foreign Application Priority Data

Jan. 26, 1999 (BR) ..... 9900165

(51) Int. Cl.[7] ..... B63B 21/32
(52) U.S. Cl. ..... 114/295; 114/301
(58) Field of Search ..... 114/294, 295, 114/300, 301, 304

(56) References Cited

U.S. PATENT DOCUMENTS

| | | | | |
|---|---|---|---|---|
| 3,508,513 | * | 4/1970 | Ilfrey et al. | 114/295 |
| 4,346,663 | * | 8/1982 | Habib et al. | 114/295 |
| 5,540,175 | | 7/1996 | Van Den Haak . | |
| 5,546,883 | | 8/1996 | Van Den Haak . | |
| 5,546,884 | | 8/1996 | Van Den Haak . | |
| 5,640,921 | | 6/1997 | Van Den Haak . | |

FOREIGN PATENT DOCUMENTS

| | | |
|---|---|---|
| 0 802 111 | 10/1997 | (EP) . |
| WO 98 36963 | 8/1998 | (WO) . |

* cited by examiner

*Primary Examiner*—Stephen Avila
(74) *Attorney, Agent, or Firm*—Nixon & Vanderhye

(57) ABSTRACT

The present invention relates to an anchor which may be buried in the seabed by means of the actual mooring line. One embodiment of such an anchor (25) comprises a fluke (1) which has rear eyes (3, 3A), front eyes (2A, 2B) and auxiliary eyes (4A, 4B). Rear mooring cables (9A, 9B) are connected to the rear eyes (3A, 3B) and front mooring cables (8A, 8B) are connected to rear connection points (17A, 17B) located on the front eyes (2A, 2B). Front installation cables (7A, 7B), which are shorter than the front mooring cables (8A, 8B), are connected to front connection points (16A, 16B) on the front eyes (2A, 2B). The remaining ends of these cables are connected to a connection plate (5), forming the anchor bobstay, and a mooring line is connected to the top of this connection plate (5). As the front installation cables (7A, 7B) are shorter than the rear mooring cables (9A, 9B), the bobstay is configured with the desired angle of attack for the burial of the anchor (25). In order that the front mooring cables (8A, 8B) do not slacken, use is made of auxiliary cables (10A, 10B) to stretch them out. When the anchor has been buried, a movement of the mooring line (6) in the opposite direction from the burial direction will cause the ends of the front installation cables (7A, 7B) to break auxillary clamps (11A, 11B) which exist at front connection points (16A, 16B), thereby releasing these ends and, consequently, making it possible for the front mooring lines (8A, 8B) to be stretched out, so as to place the anchor in its operating position.

36 Claims, 16 Drawing Sheets

ANCHOR

FIELD OF THE INVENTION

The present invention relates to a mooring device intended to be used for mooring vessels. More specifically, the present invention relates to a vertical-load mooring device intended to be used particularly for mooring vessels which are frequently moved between operating sites.

PRIOR ART

Since the beginning of offshore petroleum exploration, it has been necessary to use anchors to moor the floating units which are used, for example, for drilling production wells or subsequently for receiving and processing the oil produced.

The anchors originally used were designed to withstand only horizontal loading. To meet this requirement, it was therefore necessary for the mooring lines to extend from their point of connection with the anchors in the direction of the floating unit in an essentially horizontal configuration and then, gradually, to rise towards the floating unit to be moored, forming a catenary.

Consequently, each of the anchors was generally located at a very great distance from the floating unit, this being a distance, in the case of very deep waters, of several kilometers. With the expansion in offshore petroleum exploration and production, and also with wells being drilled in increasingly deeper waters, this catenary configuration of the mooring lines began to pose a number of problems.

One of these problems, probably the most serious, relates to the characteristic of the catenary configuration of the mooring lines requiring a very large area for mooring the floating units, especially in very deep waters, since there are situations in which interference might arise between the mooring lines of different units, which has an adverse effect on the precise location of the floating units. There may also be interference between mooring lines and flowlines for the production of the petroleum wells, particularly in regions where petroleum exploration is intense.

To solve this problem, vertical-load anchors were developed which, as their very name suggests, are capable of operating with a substantially vertical load in order to moor a floating unit, thereby substantially reducing the area required for mooring floating units.

U.S. Pat No. 5,540,175, U.S. Pat. No. 5,546,883, U.S. Pat. No. 5,546,884 and U.S. Pat. No. 5,640,921, the descriptions of which are incorporated herein by way of reference, describe anchors which are capable of receiving a vertical load, anchor flukes, and mooring methods which were devised to solve the above problems.

In the current state of the art there are also other anchors which are capable of operating with a vertical load and which solve the above problems, but which are not mentioned here as they are not relevant to the issue.

The major advantage of such anchors is their capacity to support the same load as a suction pile with a much smaller weight (an anchor is approximately 10% of the weight of a suction pile). In addition, they have the advantage that burying them is more rapid and much more economical.

Such anchors are usually installed with the aid of an anchor handling boat which is specially set up for this task, although other means may be considered. In order to be buried in the seabed, an anchor has to be deposited on the seabed in a predetermined position and then the anchor handling boat pulls on an installation line connecting the anchor to the anchor handling boat and, as a consequence, the anchor is dragged along the seabed. To make it possible for the anchor to sink into the ocean floor, an angle of attack is defined between (i) the line which is being pulled by the anchor handling boat and (ii) the anchor. This angle of attack defines the trajectory of the anchor within the ocean floor. It should be pointed out that the anchor fluke is configured in such a manner that, as the anchor is moved forward, the anchor buries itself in the ocean floor. Consequently, it is possible to obtain very deep burial over short distances of travel.

After the desired burial depth has been achieved, it is then necessary to alter the angle of attack to 90° in order to ensure maximum mooring performance, since, in this manner, the anchor will later operate as a plate subjected to a force which is perpendicular to the area of resistance.

The design and proper functioning of the device which allows the change in the angle of attack are two fundamental characteristics which determine the ease of operation of a vertical-load anchor. Basically, two different configurations are known for allowing the change in the angle of attack to take place, namely:

- a first configuration, in which two lines depart from the anchor, the first dedicated only to the burial of the anchor in the ocean floor and the second intended to operate as a mooring line;
- a second configuration, in which only one line extends from the anchor, this fulfilling both functions (burial and anchoring).

The first, two-line, configuration requires the use of two support vessels, one for burying the anchor in the ocean floor and the other for connecting the mooring line to the floating unit to be moored.

The second, single-line, configuration is obviously more economical since, in addition to requiring less equipment, it allows the anchor to be buried with the use of only one vessel. In this case, it is necessary to use special devices to change the angle of attack to 90°.

Devices which are known in the prior art for changing the angle of attack in the case of the single-line configuration use shearing pins. In this situation, the anchor's front mooring cables, which are the same length as the anchor's rear mooring cables, have their length temporarily reduced, by means of a device which uses the shearing pins, in order thereby to promote the angle of attack for full burial of the anchor.

The shearing pins are designed to break when the anchor has been buried to a predetermined burial depth. In other words, when the anchor has reached the planned burial depth, the load exerted by the anchor's front mooring cables on the shearing pins will cause the pins to break. Consequently, the front mooring cables will then be the same length as the rear mooring cables, and the anchor will be ready to be taken to its correct operating position, in accordance with techniques which are not described here as they are widely known in the prior art.

The shearing-pin concept is a solution which has already been tested successfully, although it presents a number of drawbacks. The first of these is the definition of the pin's breaking load, which depends on precise knowledge of the characteristics of the ocean floor. This type of knowledge involves having a special vessel available to gather samples from the ocean floor for analysis, with a view to determining more accurately the resistance of the ocean floor to burial of the anchor, in order to give the shearing pin the dimensions it requires for breaking when the anchor has reached the desired burial depth.

As mooring radii are large, the situation may arise in which a number of anchors in the same mooring system are located in regions where the ocean floor has different characteristics and, consequently, there may be differences in the loads required for the shearing pins of the various anchors to break, which requires a greater number of samples to be gathered, thereby making the mooring process more expensive.

The second problem relates to the fact that, if a shearing pin breaks before the anchor has reached the desired burial depth, it is necessary to remove the anchor from the ocean floor in order to repeat the burial operation since, once the pin has broken, it is no longer possible to attempt to reach the desired burial depth.

Another negative point relates to the fact that current removal systems require a precise procedure for the movement of the handling boat in order to prevent damage to the anchor, and this frequently requires the operation to be repeated, thereby making it more expensive.

OBJECTS AND SUMMARY OF THE INVENTION

It is a main object of the present invention to provide an anchor which may be buried in the ocean floor by means of its own mooring line.

In addition, it is an object of the present invention to propose an anchor which does not use shearing pins to determine the burial depth, which makes the burial operation less risky and more economical.

A first embodiment of the present invention is related to an anchor comprising a fluke which has rear eyes, front eyes and auxiliary eyes. Rear mooring cables are connected to the rear eyes and front mooring cables are connected to rear connection points located on the front eyes. Front installation cables, which are shorter than the front mooring cables, are connected to front connection points on the front eyes. The remaining ends of these cables are connected to a connection plate forming the anchor bobstay, and a mooring line is connected to the top of this connection plate. The front installation cables are shorter than the rear mooring cables and the bobstay is configured with the desired angle of attack for burial of the anchor. In order that the front mooring cables do not slacken, use is made of auxiliary cables to stretch them out. When the anchor has been buried, a movement of the mooring line in the direction opposite from the burial direction will cause the ends of the front installation cables to break auxiliary restraining means which exist at the front connection points, thereby releasing these ends and consequently making it possible for the front mooring cables to be stretched out, so as to place the anchor in its operating position. When necessary, the anchor may be withdrawn by means of an orientation and removal line, which is fixed to a removal ring rigidly secured to the rear part of the anchor.

In a second aspect of the present invention, said rear mooring points may have auxiliary restraining means which are capable of being broken by said front mooring cables when the anchor is withdrawn, which makes it possible to withdraw the anchor by means of the mooring cable itself.

In a third aspect of the present invention, front installation cables are connected to front connection points on the front eyes, and extensions of the front installation cables are connected to rear connection points on the front eyes. The free ends of said extensions of the front installation cables are connected to the ends of the front installation cables which were connected to the front connection points of the front eyes. After burial of the anchor, the mooring cable is pulled in a direction opposite from the burial direction, which causes the ends of the front installation cables to break auxiliary clamps which exist on the front connection points of the front eyes. The front mooring cables are then formed by the front installation cables joined to the installation-cable extensions. When necessary, the anchor may be withdrawn by means of an orientation and removal line, which is secured to a removal eye rigidly secured to the rear part of the anchor.

In a fourth aspect of the present invention, the rear connection points, where the extensions of the front installation cables are connected, have auxiliary clamps which may be broken so that it is possible to recover the anchor by means of the mooring cable itself.

DESCRIPTION OF PREFERRED EMBODIMENTS OF THE INVENTION

Figure 1:
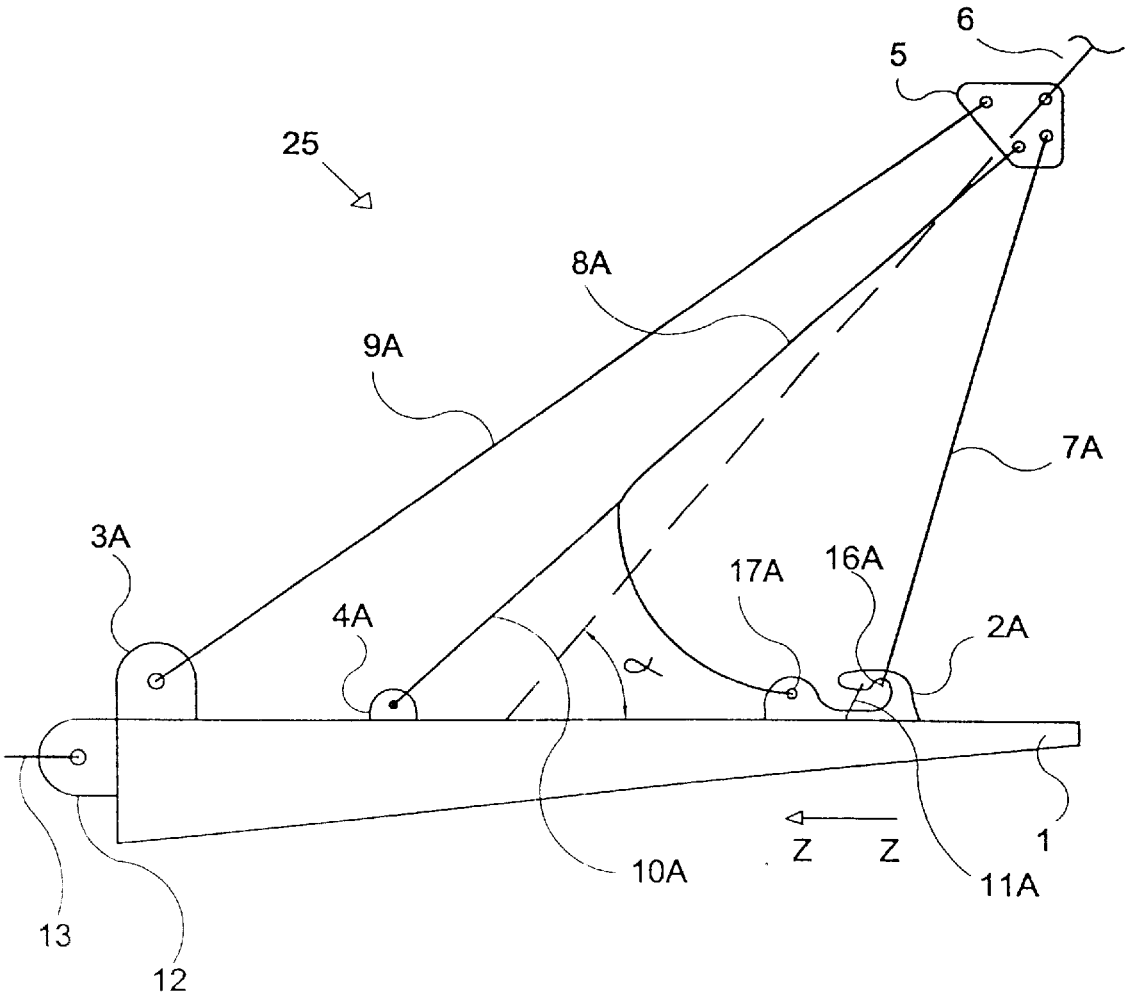
FIG. 1 is a side view of a first embodiment of anchor in accordance with the present invention, in its final operating position after burial and prior to actuation of the device for changing the angle of attack.
Figure 1A:
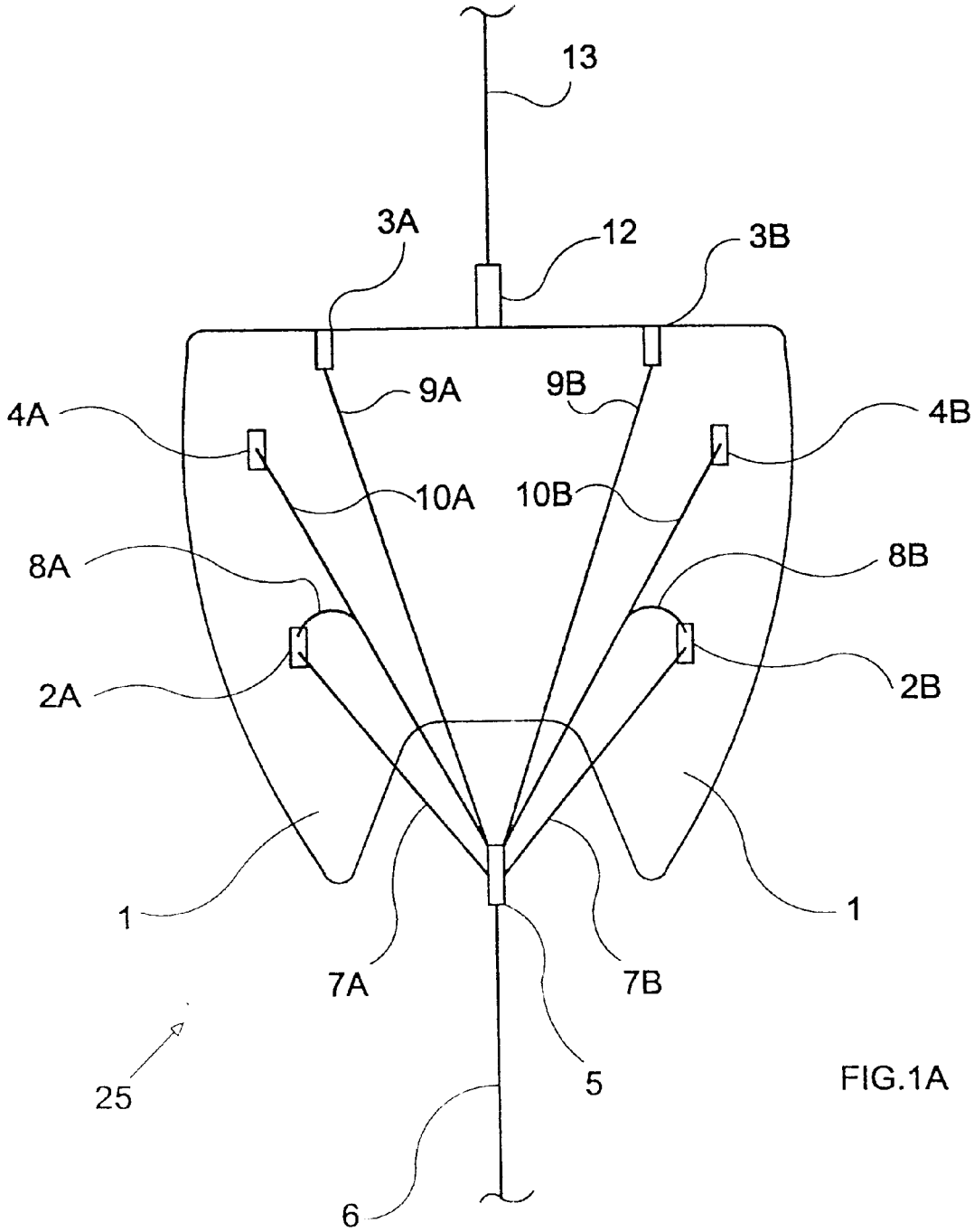
FIG. 1A is a top plan view of the anchor of FIG. 1.
Figure 2:
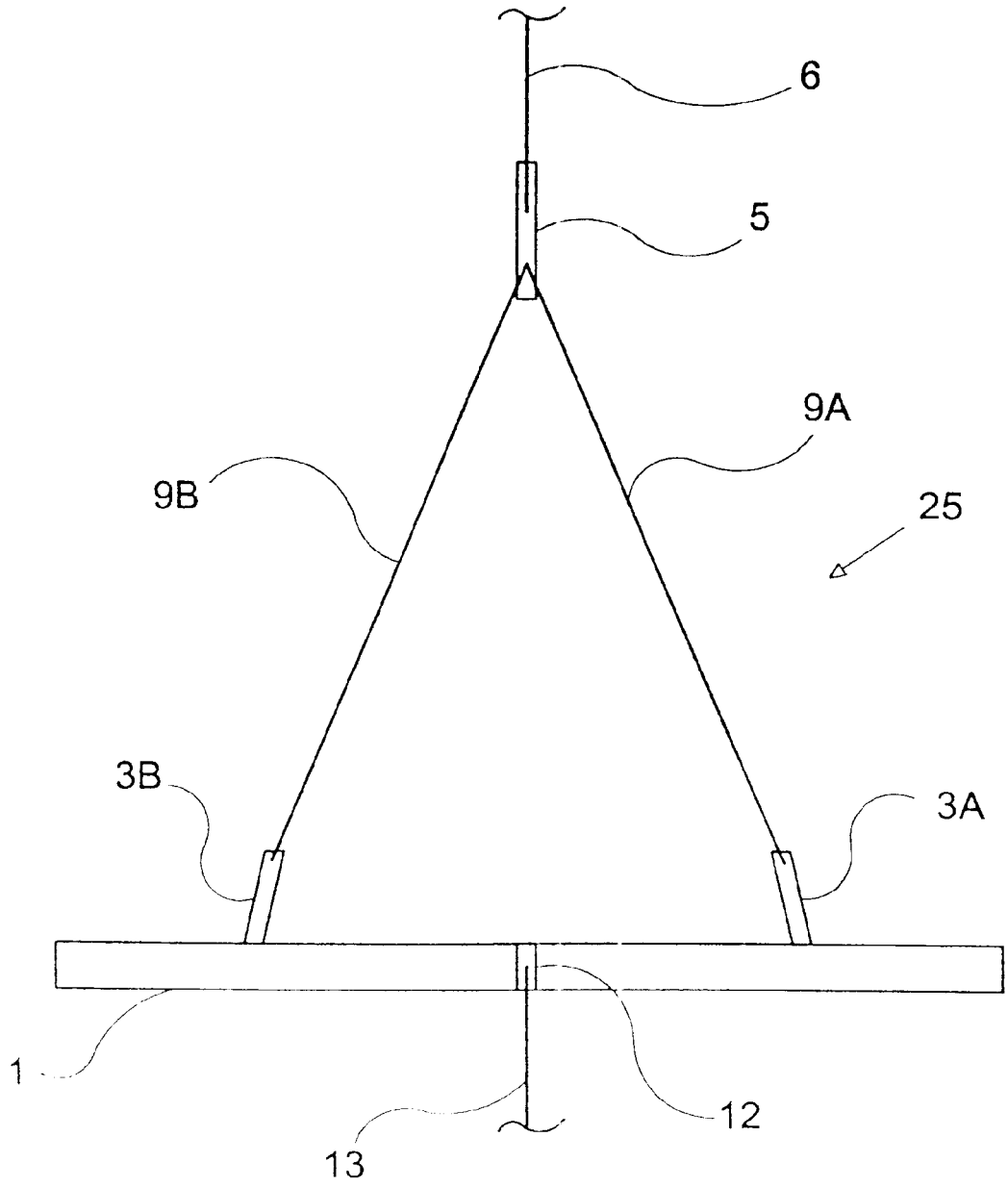
FIG. 2 is a rear view of the anchor of FIG. 1.

FIGS. 1, 1A and 2 are, respectively, a side view, a top plan view and a rear view of a first embodiment of an anchor 25 according to the present invention, in a "ready-for-burial" position, prior to the change in the angle of attack. Their may be seen an anchor fluke member 1, a pair of front eyes 2A, 2B, a pair of rear eyes 3A, 3B, a pair of auxiliary eyes 4A, 4B and a removal eye 12 to which an end of an orientation and removal line 13 is connected.

An end of an anchor pulling line which, in the present embodiment is the actual mooring line 6, is firmly connected to a connecting plate 5 and the other end of this mooring line 6 is firmly connected to an anchor handling boat (not shown in the drawings) which will effect burial of the anchor.

It is also possible to observe two rear mooring cables 9A, 9B and two front mooring cables 8A, 8B, each of which also has its upper end firmly connected to the connecting plate 5. The rear mooring cables 9A, 9B and the front mooring cables 8A, 8B are of substantially the same length. The lower ends of each of the rear mooring cables 9A, 9B are firmly connected to the respective rear eyes 3A, 3B, and the lower ends of each of the front mooring cables 8A, 8B are firmly connected to respective rear connection points 17A, 17B located, respectively, on the front eyes 2A, 2B.

Two front installation cables 7A, 7B, which are of substantially equal length, have their upper ends firmly connected to the connecting plate 5 and their lower ends secured to respective front connection points 16A, 16B located on the front eyes 2A, 2B, respectively.

The rear connection points 17A, 17B are intended for permanent connection to their respective front mooring cables 8A, 8B and the front connection points 16A, 16B are intended for temporary connection to their respective front installation cables 7A, 7B, as will be seen in greater detail below.

Two auxiliary cables 10A, 10B are firmly connected at one of their ends to respective auxiliary eyes 4A, 4B and the other end of each of these auxiliary cables 10A, 10B is temporarily attached to a predetermined point of its respective front mooring cable 8A, 8B in a manner which will be explained below.

The anchor 25 has to be launched into the sea by an anchor handling boat using the mooring line 6. The anchor will have to have the configuration shown in FIGS. 1 and 1A. The front installation lines 7A, 7B, in conjunction with the front mooring lines 8A, 8B and the rear mooring lines 9A, 9B form a bobstay for the anchor 25. The purpose of the connecting plate 5 is to group the six cables of the bobstay and the mooring line 6 together in one and the same component.

The front mooring cables 8A, 8B and the rear mooring cables 9A, 9B are the same length. The front installation cables 7A, 7B are shorter in order to obtain the desired angle of attack between the mooring line 6 and the anchor fluke 1. Therefore, it is the length of the front installation cables 7A, 7B which will define the angle a shown in FIG. 1, which is formed by the mooring line 6 and the anchor fluke member 1, which is the angle of attack of the anchor 25 for its burial in the ocean floor.

The auxiliary cables 10A, 10B are used during burial of the anchor 25 to keep the front mooring cables 8A, 8B stretched and in line with the front installation cables 7A, 7B and with the rear mooring cables 9A, 9B, so as not to generate greater resistance to the advance of the anchor 25 in the seabed at the time of its burial.

Auxiliary restraining means 11A, 11B located at the front connection points 16A, 16B, respectively, are intended to prevent the change in the angle of attack of the anchor, i.e. the $\alpha$, during handling on the deck of the boat. In other words, these auxiliary restraining means 11A, 11B prevent the front connection cables 7A, 7B being disconnected from their respective connection points 16A, 16B, which would change the angle of attack of the anchor. The auxiliary restraining means 11A, 11B are dimensioned in such a way as to withstand only those forces which arise during handling of the anchor 25 on the anchor handling boat. FIG. 10A shows a front eye 2A and on it the details mentioned above may be seen more clearly.

The operation of deploying the anchor buried in the seabed is now described.

Initially, using a mooring line 6, an anchor handling boat will drop the orientation and removal line 13 and the anchor 25, as far as the seabed, at a predetermined spot.

The anchor 25 will then be pulled by the anchor handling boat in a predetermined direction, by means of the mooring line 6, into the position shown in FIGS. 1 and 1A, until the anchor 25 has reached the burial depth preestablished in the mooring plan.

The anchor handling boat will then pull the mooring line 6 in the opposite direction from the anchor burial direction until the front installation cables 7A, 7B break the auxiliary restraining means 11A, 11B. When this occurs, the front installation cables 7A, 7B will no longer be attached to their respective front connection points 16A, 16B and the movement of these front installation cables 7A, 7B in the direction of the arrow Z—Z shown in FIG. 1, as a consequence of the mooring line 6 being pulled in the opposite direction from that of burial of the anchor, will release them from their connection to their respective front connection points 16A, 16B.

It should be noted that the specific shape of the front connection points 16A, 168 on the front eyes 2A, 2B, which is similar to an "L", means that the ends of the front installation cables 7A, 78 remain held inside them when the anchor is being buried, and when the movement of the mooring line 6 is reversed, as described above, this specific shape of the front connection points 16A, 168 will facilitate the release of the ends of the front installation cables 7A, 78 which were held inside them.

Figure 3:
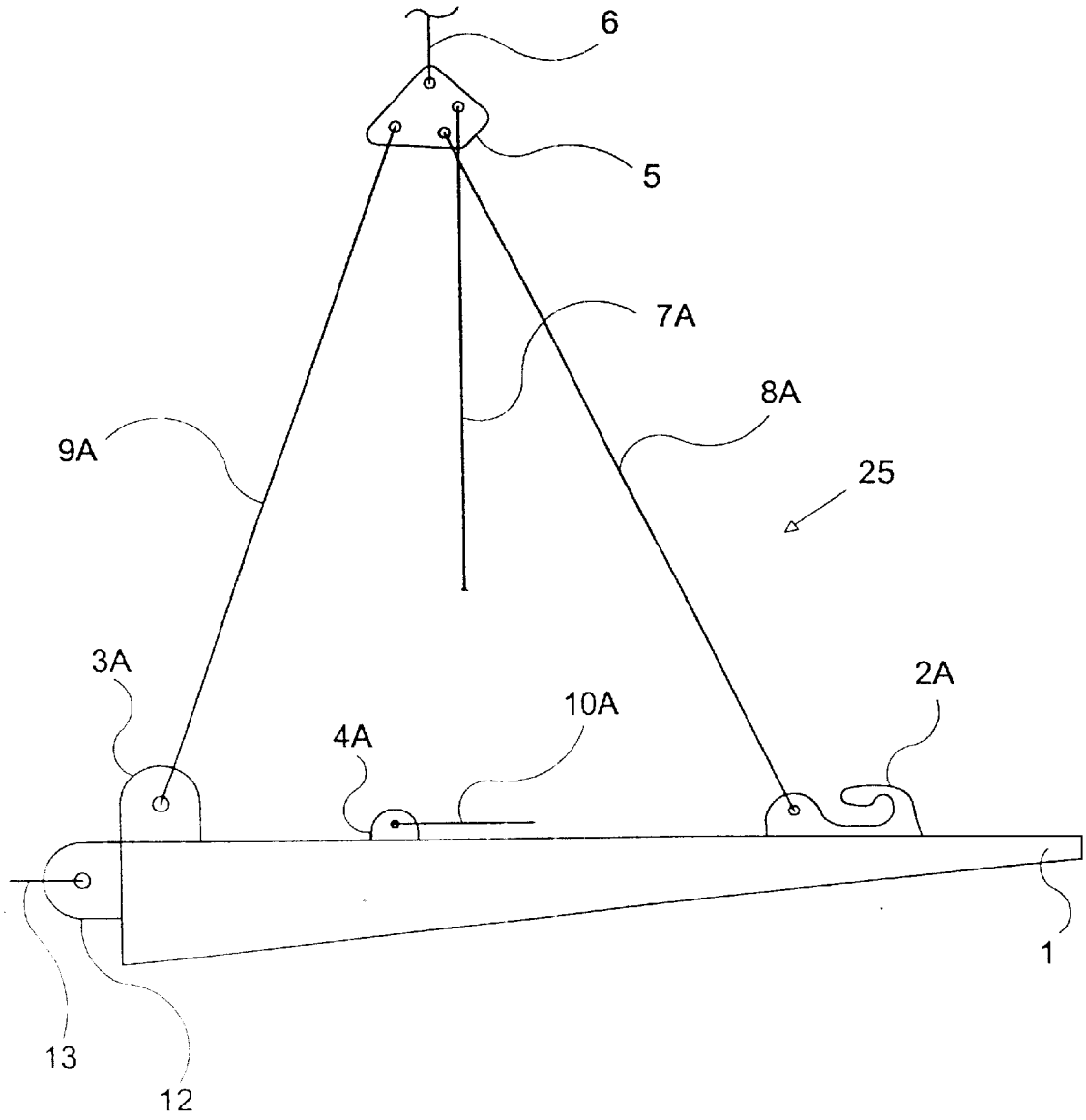
FIG. 3 is a side view of the anchor of FIG. 1, after actuation of the device for changing the angle of attack.
Figure 3A:
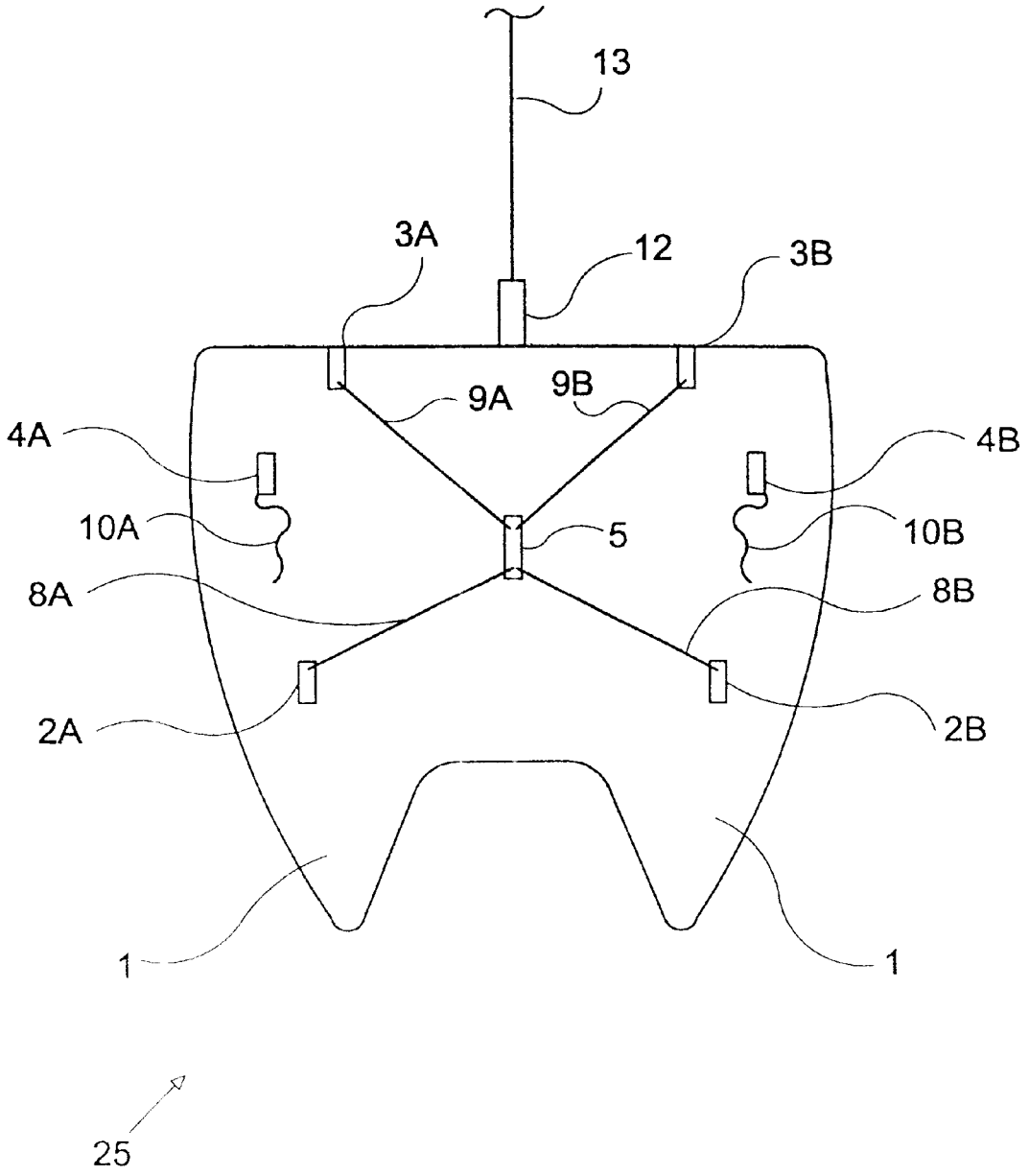
FIG. 3A is a top plan view of the anchor of FIG. 3.
Figure 4:
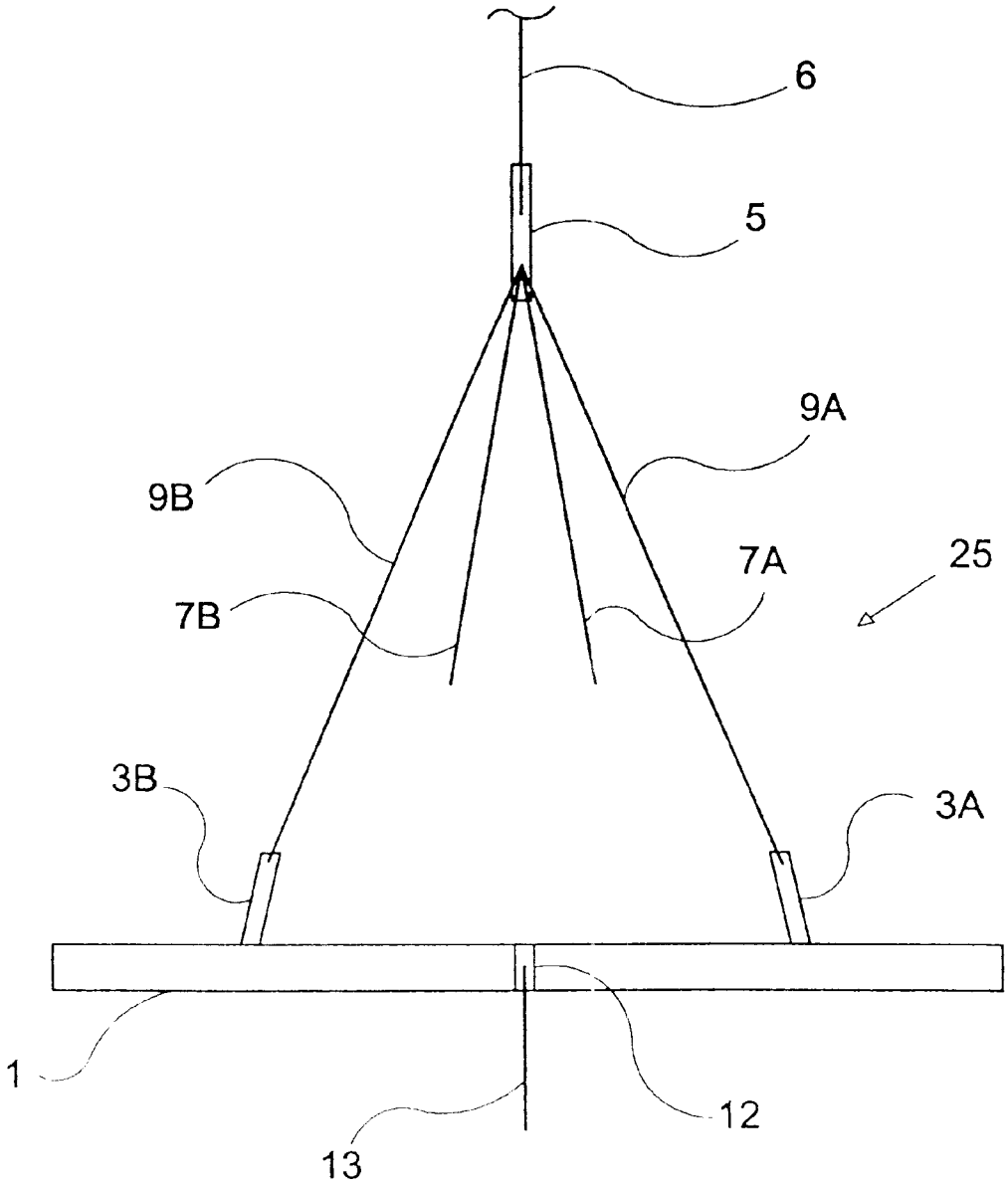
FIG. 4 is a rear view of the anchor of FIG. 1, after actuation of the device for changing the angle of attack.

After the auxiliary restraining means 11A, 118 have broken, the front mooring cables 8A, 8B will be released in order to extend and they will give rise to the breakage of the respective auxiliary cables 10A, 10B. When this occurs, the angle of attack of the mooring line 6 with respect to the anchor fluke member 1 of the anchor 25 changes to substantially 90°, in which position maximum mooring efficiency is obtained. The anchor 25 will then adopt the position shown in FIGS. 3, 3A and 4 and is ready to be connected subsequently at its final destination on the floating unit it is to moor.

When it is necessary to remove the anchor 25, something which may occur frequently in the case of drilling floating units, it will suffice for an anchor handling boat to pull the anchor by means of the orientation and removal line 13, in which situation the angle of attack is 0° (zero degrees), i.e. the removal force will be minimal.

Figure 5:
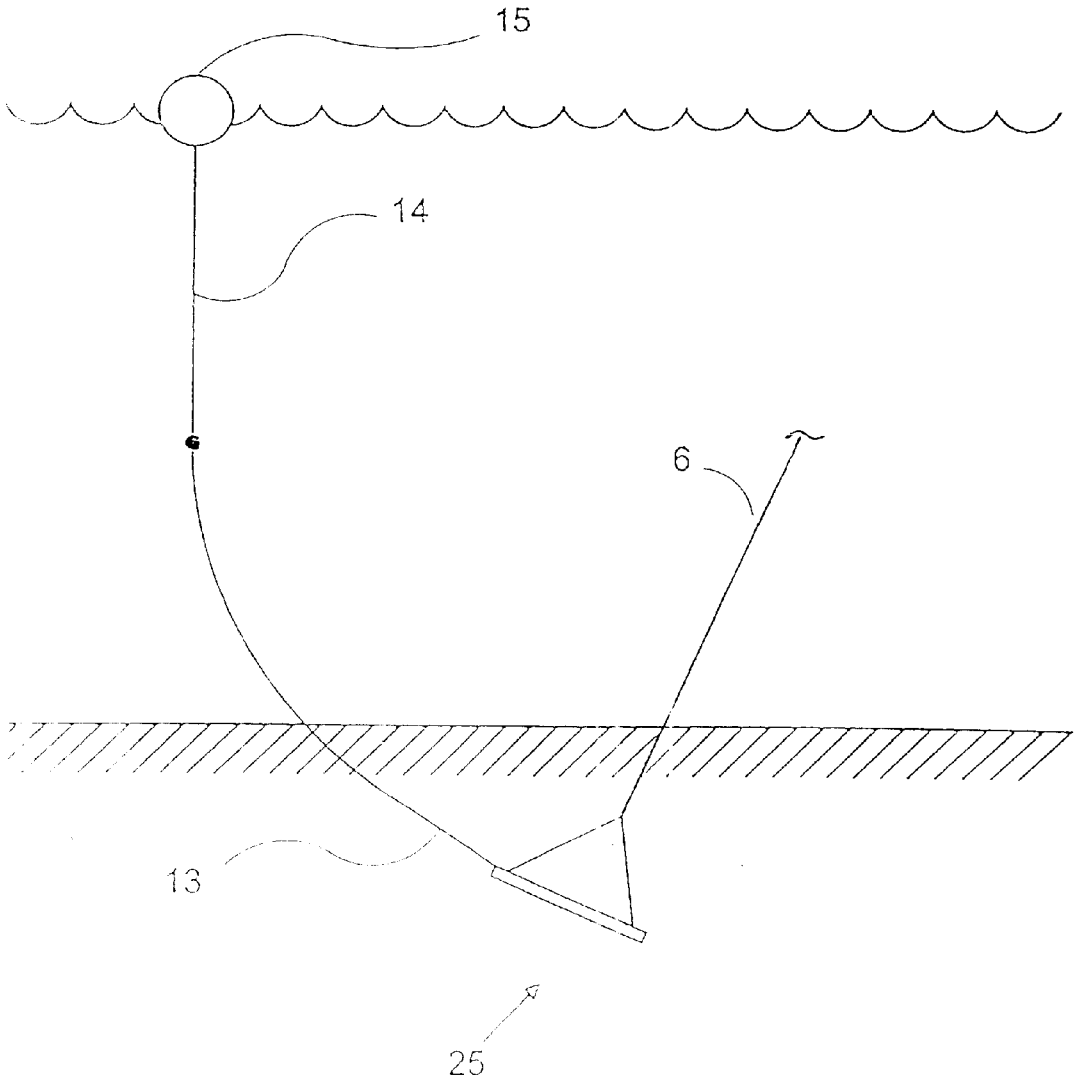
FIG. 5 is a diagrammatic side view of the anchor of FIG. 1, showing provisions for removing it from the ocean floor.

To facilitate removal, the orientation and removal lines 13 may be connected to the end of an auxiliary recovery line 14, as shown in FIG. 5, which has its other end connected to a surface buoy 15. It will then suffice for the anchor handling boat to recover the surface buoy 15 and then to pull on the auxiliary recovery line 14 which is connected to the orientation and recovery line 13 in order to remove the anchor 25 from its burial spot and to haul it to the surface.

Figure 6:
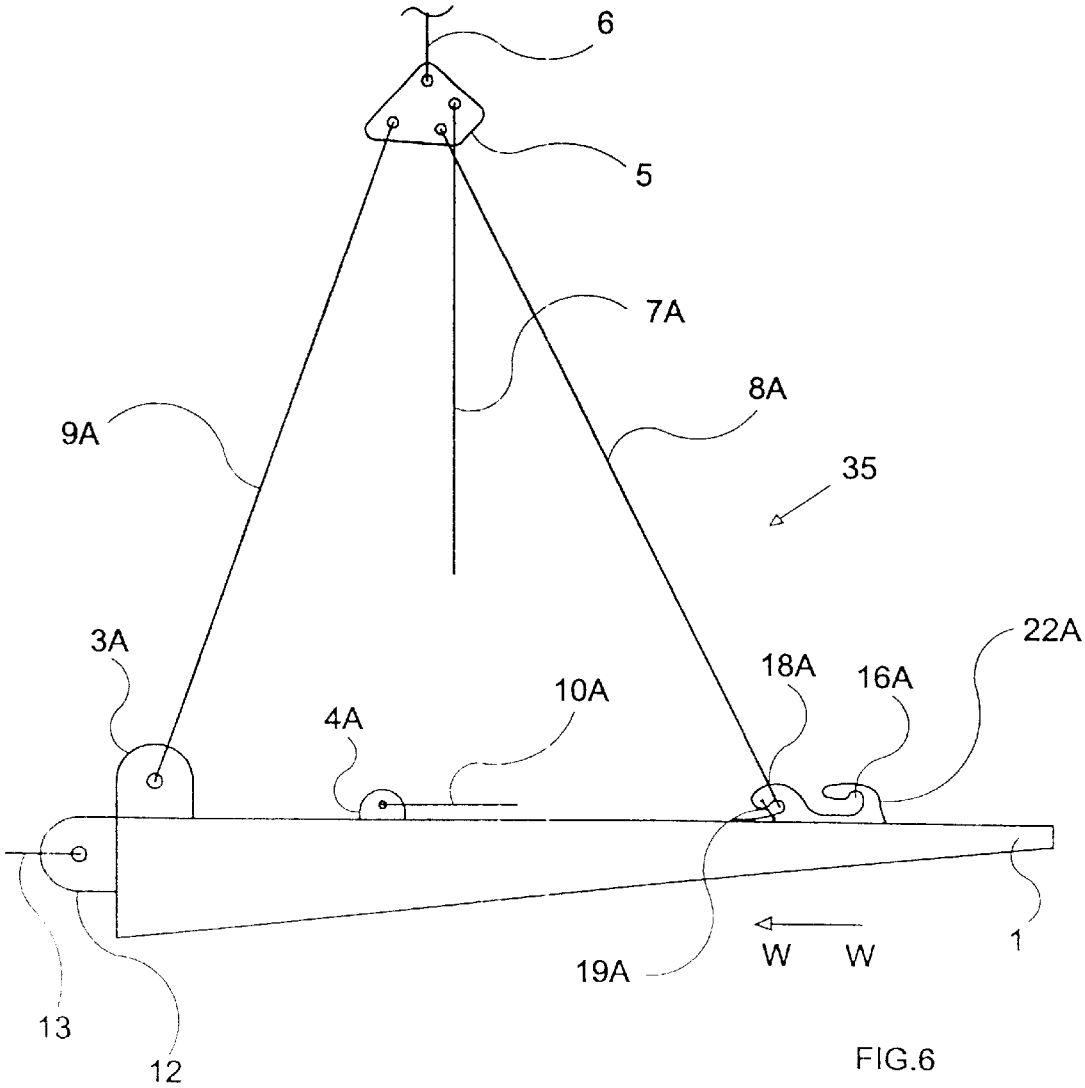
FIG. 6 is a side view of a second embodiment of an anchor, in accordance with the present invention, in its final operating position after burial and after actuation of the device for changing the angle of attack.
Figure 6A:
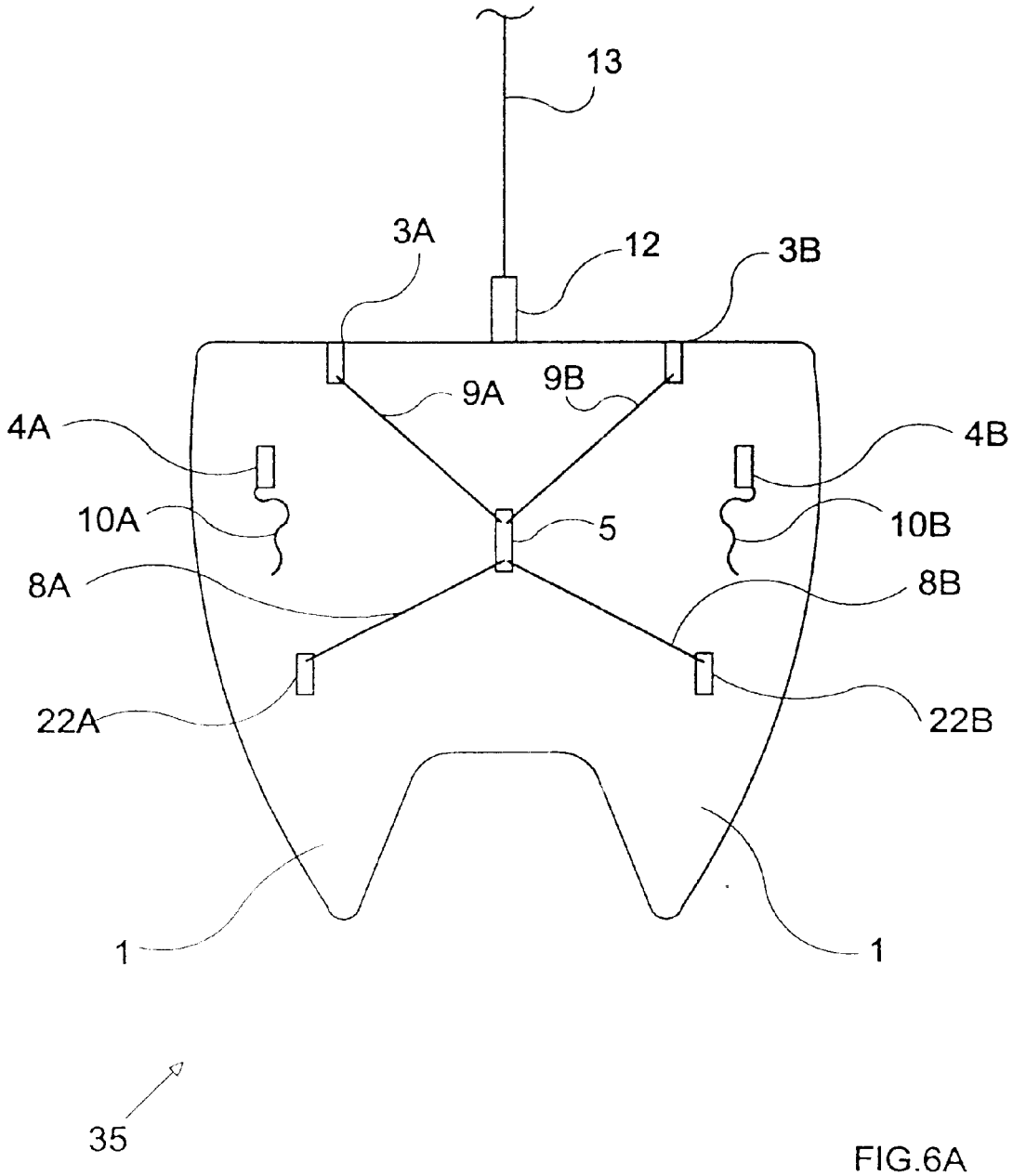
FIG. 6A is a top view of the anchor of FIG. 6.

FIGS. 6, 6A show a side view and a top plan view of a second embodiment of an anchor 35, according to the present invention, which is in its final operating position after burial and after actuation of the device for changing the angle of attack. This anchor 35 is similar to the anchor 25 described above and its principal components are basically the same as those of the anchor 25, the same reference numerals having been used to identify them. This anchor 35 is buried in the same way as described above for the anchor 25. The only difference between these two anchors is in the front eyes 22A, 22B of the anchor 35, which are different from the front eyes 2A, 2B of the anchor 25.

Figure 10B:
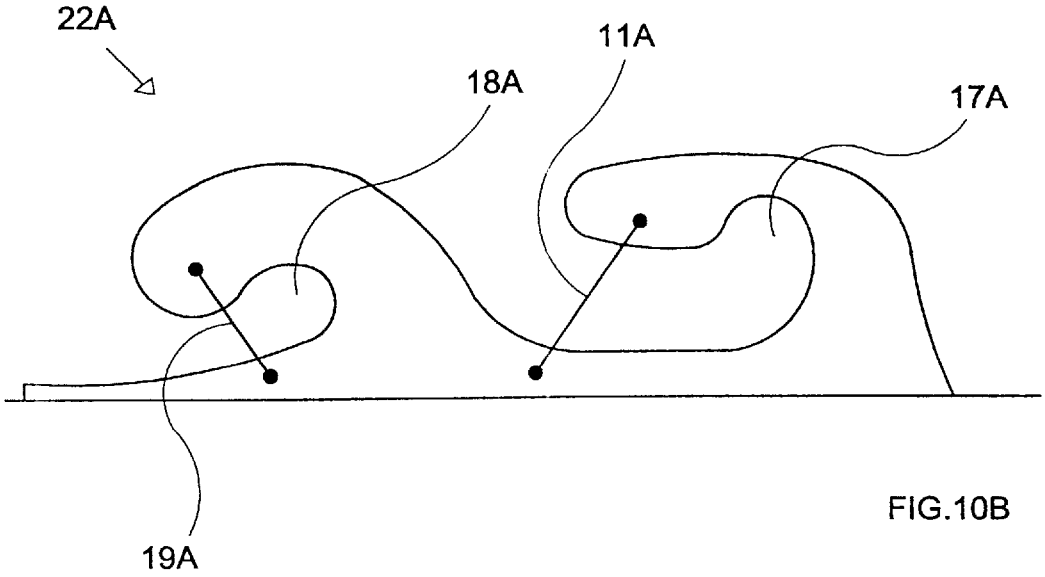
FIG. 10B is a side view of a second type of front eye for an anchor according to the present invention.
Figure 10A:
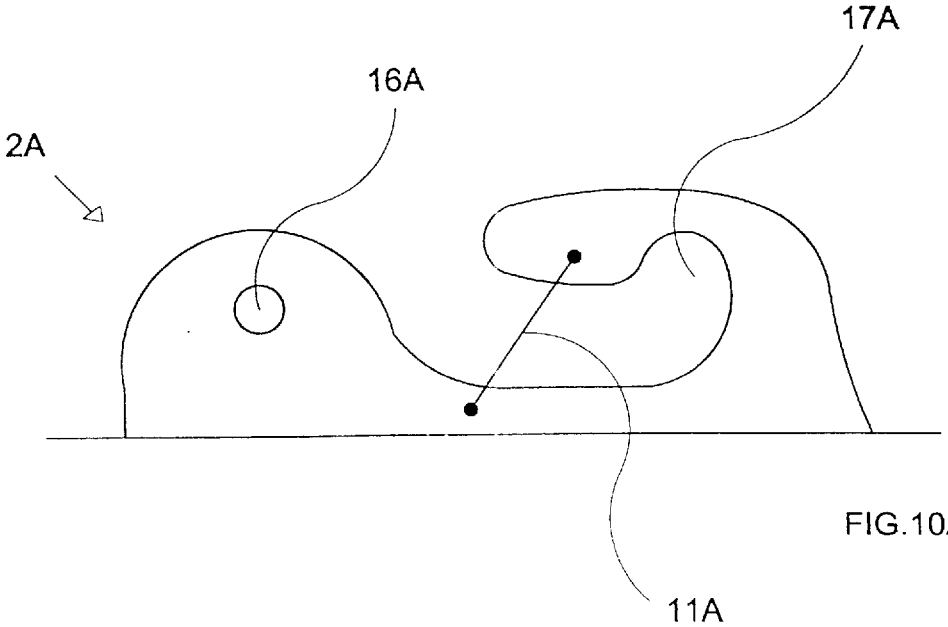
FIG. 10A is a side view of a first type of front eye for an anchor according to the present invention.

In FIG. 6, FIG. 6A, and FIG. 10B which shows the constructional details of a front eye 22A more clearly, it is possible to observe that the lower ends of each front mooring cable 8A, 8B are connected to respective rear connection points 18A, 18B and these are respectively provided with auxiliary restraining means 19A, 19B which are intended to hold the lower ends of the front mooring cables 8A, 8B secured to the rear connection points 18A, 18B until the anchor has been withdrawn, as will be seen below.

The configuration of the front eyes 22A, 22B makes it possible to withdraw the anchor 35 by means of the actual mooring line 6. To this end, the mooring line 6 must initially be moved in an opposite direction from the burial direction of the anchor 35. When this occurs, the end of each front mooring cable 8A, 8B which is connected to its respective rear connection point 18A, 18B of the front eye 22A, 22B will be forced backwards in the direction of the arrow W—W shown in FIG. 6 and, consequently, the restraining means 19A, 19B will be broken, thereby releasing the ends of the front mooring cables 8A, 8B.

Figure 6B:
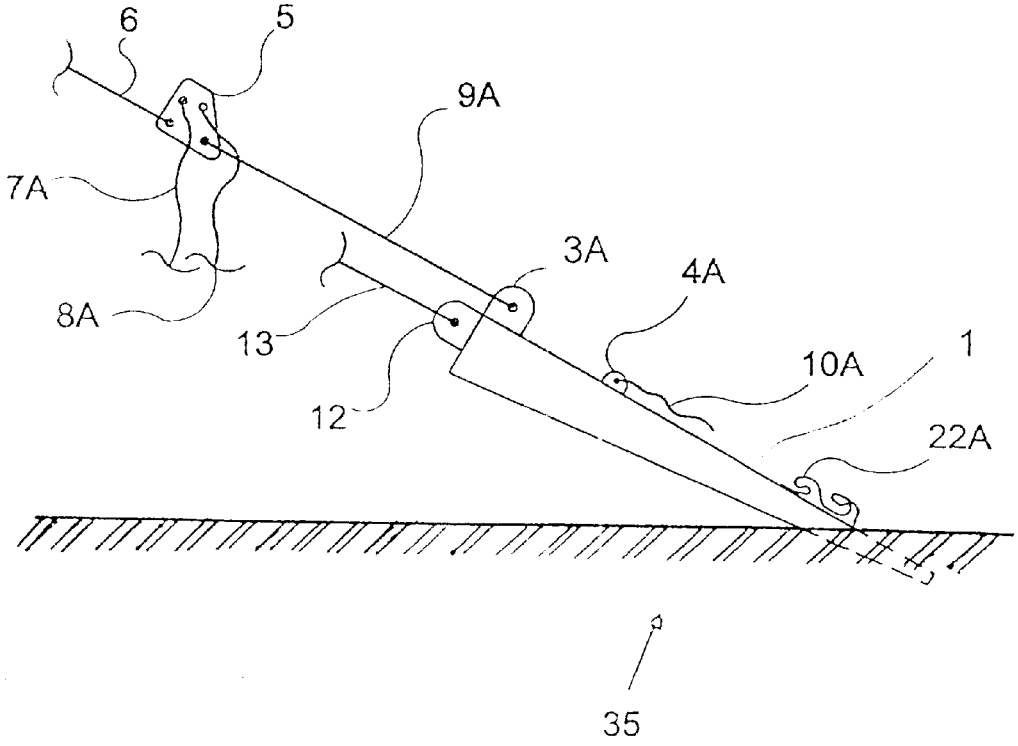
FIG. 6B is a side view of the anchor of FIG. 6 being withdrawn by means of its rear mooring lines.

When this occurs, it will then be possible for the anchor 35 to be removed by means of the rear mooring cables 9A, 9B since these will remain connected to their respective rear eyes 3A, 3B and, with the continuation of the movement of the mooring line 6 in an opposite direction from the burial direction of the anchor 35, the mooring line 6 will pull the rear mooring cables 9A, 9B in the opposite direction from the burial direction of the anchor 35, as shown in FIG. 6B; it will thus be possible to withdraw the anchor 35 with an angle of attack of 0° (zero degrees), i.e. the removal force will be minimal.

Figure 7:
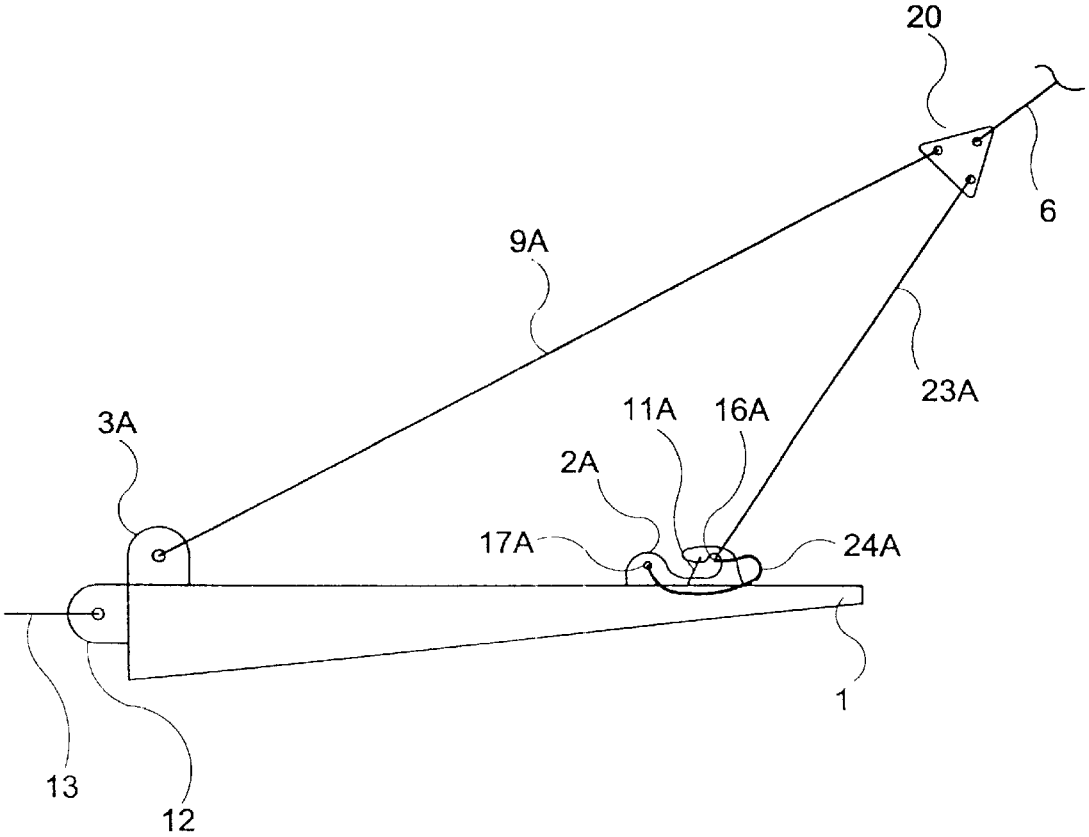
FIG. 7 is a side view of a third embodiment of an anchor in accordance with the present invention, in a position ready for burial.
Figure 7A:
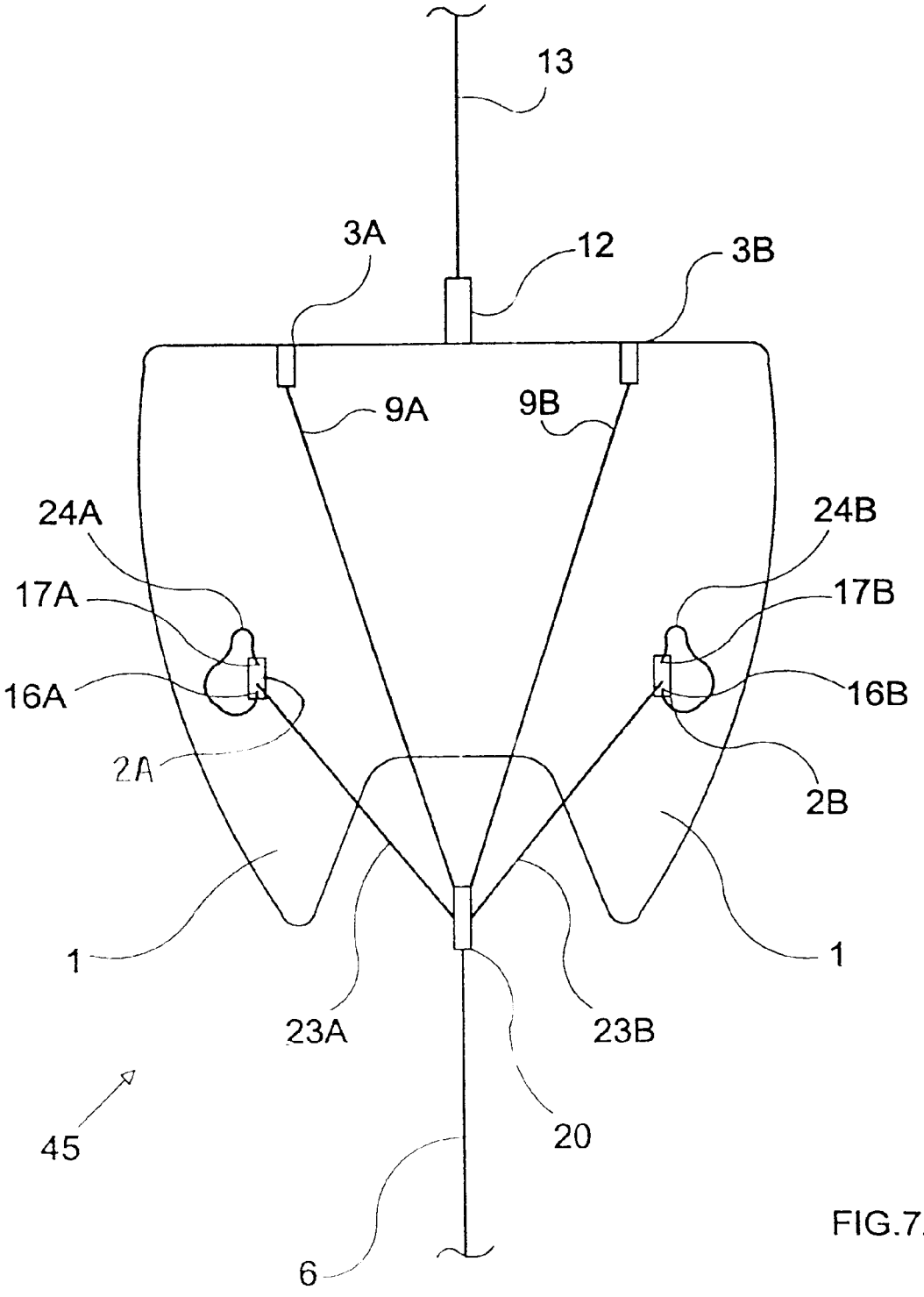
FIG. 7A is a top view of the anchor of FIG. 7.
Figure 8:
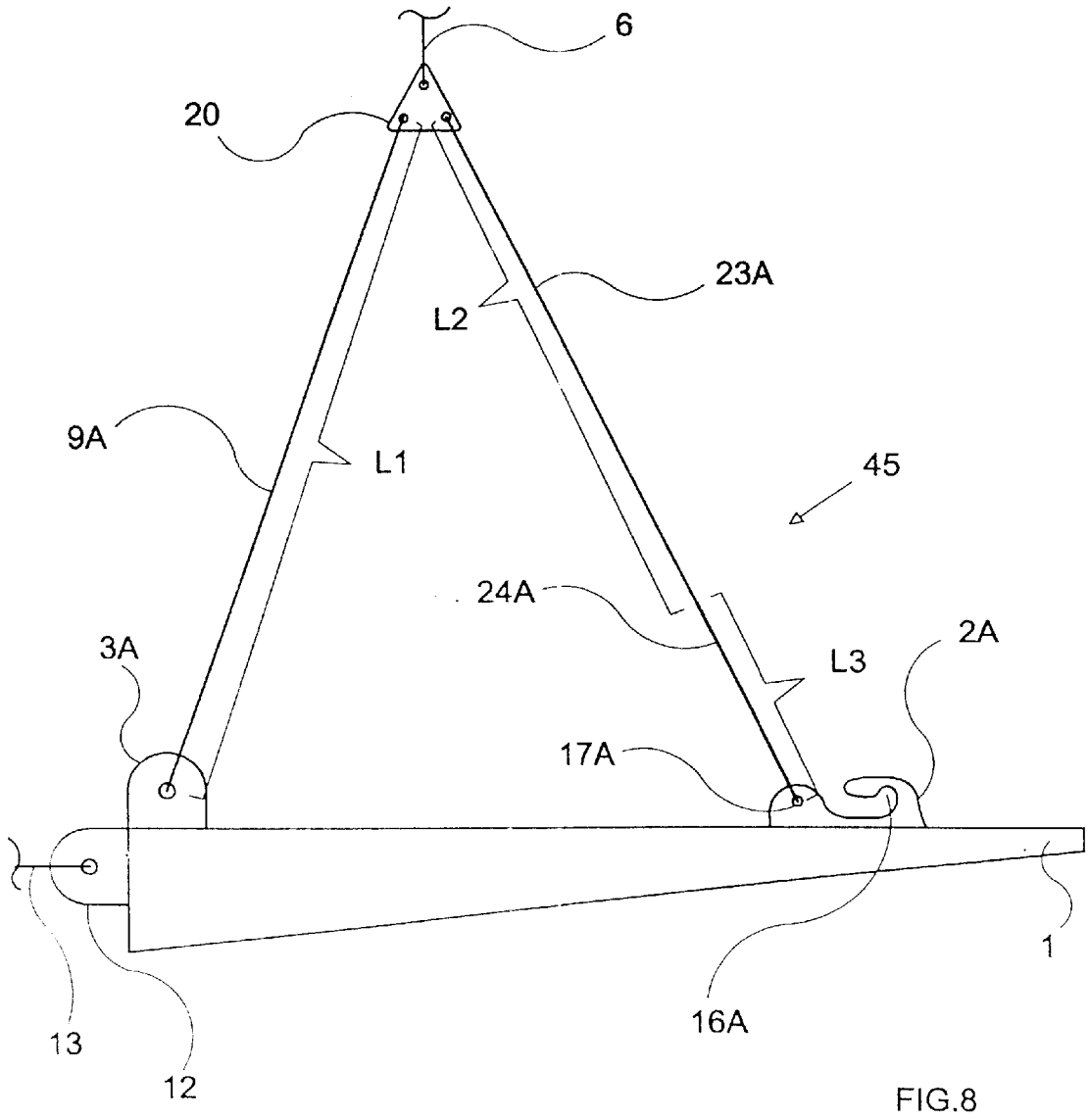
FIG. 8 is a side view of a variant of the third embodiment of an anchor of the present invention shown in FIG. 7, in its final operating position after burial and after actuation of the device for changing the angle of attack.

FIGS. 7 and 7A show, respectively, a side view and a top plan view of a third embodiment of an anchor 45 according to the present invention, which is in its burial position. In FIG. 8, the anchor 45 is shown in its operating position, after burial and after actuation of the device for changing the angle of attack. This anchor 45 is similar to the anchors 25, 35 described above. Since its principal components are basically the same as those of the anchors 25 and 35, the same reference numerals have been used to identify them. The principal difference between the anchor 45 and the anchors 25 and 35 lies in the fact that only four cables are used in the bobstay of the anchor 45 instead of the six cables used in the anchors 25 and 35, as will be seen below.

For the anchor 45 to be buried it is necessary for it to have, at the time of its burial, front installation cables which have a length which is shorter than that of its rear mooring cables so as to form the appropriate angle of attack for burial. To this end, as may be observed in FIGS. 7 and 7A, each of the front mooring cables is composed of two segments, namely a front installation cable 23A, 23B and an extension of the front installation cable 24A, 24B.

At the time of burial, the front installation cables 23A, 23B have their lower ends connected to front connection points 16A, 16B, respectively, located on the front eyes 2A, 2B, respectively. The lower ends of each front installation cable 23A, 23B are also connected to one of the ends of the extensions of the front installation cable 24A, 24B, respectively. The other ends of each front installation cable 24A, 24B are firmly connected, respectively, to rear connection points 17A, 17B located on the front eyes 2A, 2B, respectively. The upper ends of the front installation cables 23A, 23B and the upper ends of the rear mooring cables 9A, 9B are connected to a connection plate 20 whose top is connected to the mooring line 6.

The anchor 45 is buried in the same way as described for the anchor 25, during which the anchor handling boat pulls the mooring line 6 in a specified direction until the desired burial depth is achieved. The direction of travel of the anchor handling boat is then reversed, which causes the auxiliary restraining means 11A, 11B which exist on the front connection points 16A, 16B to break when the ends of the front installation cables 23A, 23B are forced against them, because of the reversal of the movement of the mooring cable 6.

As the lower ends of the front installation cables 23A, 23B are connected to the front ends of the extensions of the front installation cable 24A, 24B, respectively, and the other ends of the extensions are, respectively, connected to the rear connection points 17A, 17B, respectively located on the front eyes 2A, 2B, each of the two sets formed by the connection of the front installation cables 23A, 23B to the extensions of the installation cable 24A, 24B will form one of the two front mooring cables of the anchor 45.

It should be mentioned that the length L, of the rear mooring cable is equal to the sum of the lengths $L_2$ of the front installation cables 23A, 23B and $L_3$ of the extensions of the front installation cable 24A, 24B, respectively. In this way, pulling on the bobstay of the anchor 45 which is formed by these cables will be substantially vertical, conferring on the anchor 45 the greatest possible anchoring load.

Withdrawal of the anchor 45, when required, will take place in the same way as described for withdrawal of the anchor 25, i.e. by means of the orientation and removal line 13.

Figure 9:
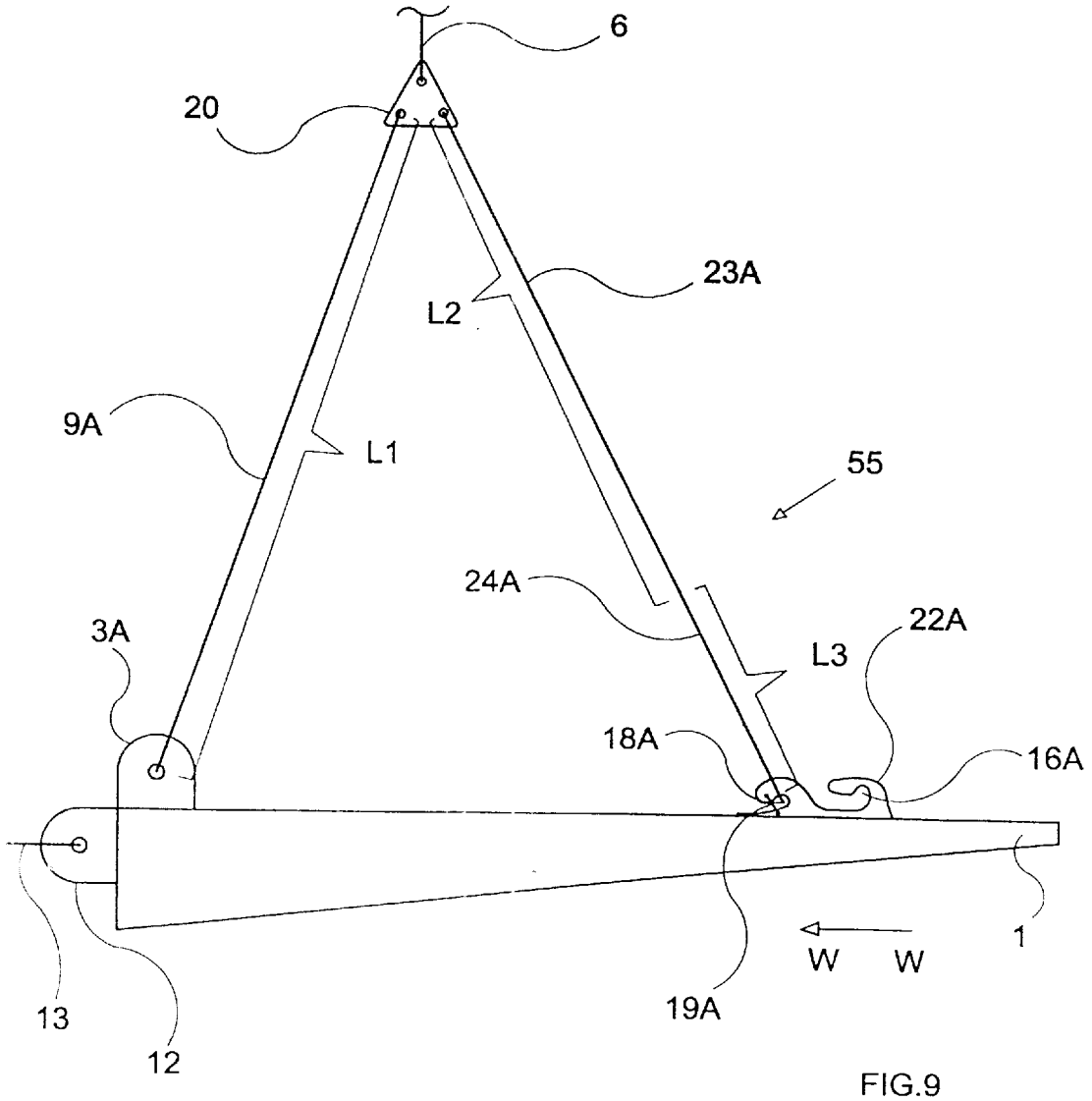
FIG. 9 is a top plan view of the anchor of FIG. 7.

FIG. 9 shows a fourth embodiment 55 of an anchor according to the present invention. This anchor is almost totally identical to the anchor 45 described above. The only difference is the use of the front eyes 22A, 22B which were described above for the anchor 35. In this case, the lower ends of the extensions of front installation cables 24A, 24B are, respectively, connected to the rear connection points 18A, 18B located on the front eyes 22A, 22B, respectively.

As was stated earlier, the rear connection points 18A, 18B are provided with auxiliary restraining means 19A, 19B, respectively. This allows the easy removal of the anchor 55 by means of the mooring line 6 itself, as was described for the anchor 35, i.e. a movement of the mooring line in the direction of the arrow W—W shown in FIG. 9 will cause the ends of the extensions of front installation cables 24A, 24B to break their respective auxiliary restraining means 19A, 19B and therefore it will be possible to withdraw the anchor 55 with an angle of attack of 0° (zero degrees), i.e. the removal force will be minimal.

Figure 7B:
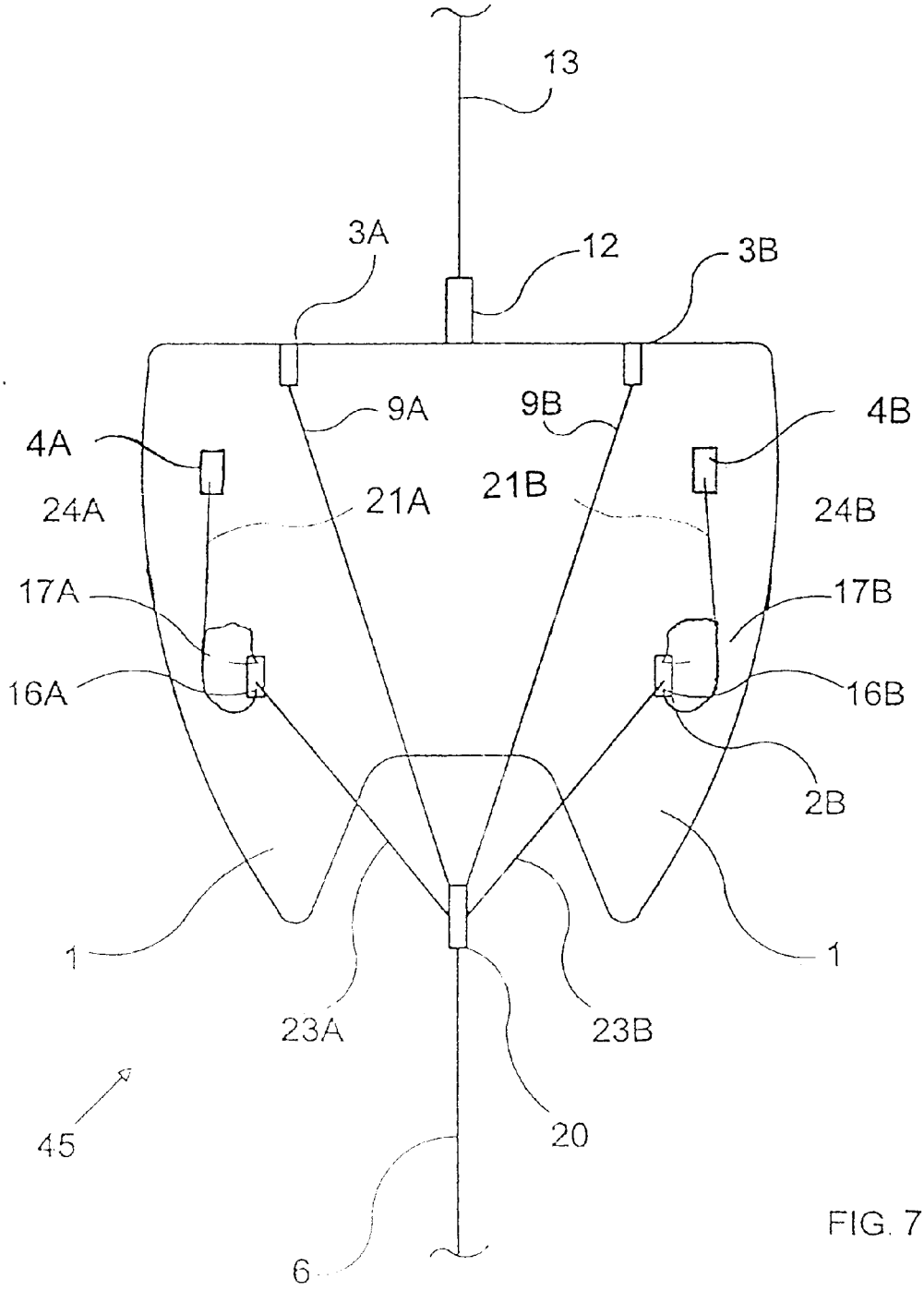
FIG. 7B is a top view of the anchor of FIG. 7, in which optional auxiliary cables are shown.

Auxiliary cables 21A, 21B may be used during burial of the anchors 45, 55 to keep the extensions of front installation cables 24A, 24B stretched so as not to generate greater resistance to the advance of the anchor 45, 55 in the ocean floor at the time of its burial, as shown, in particular, in FIG. 7B in the case of the anchor 45. In this case, one of the ends of each of the auxiliary cables 21A, 21B must be releasably attached at a specific point of its respective extension of the front installation cable 24A, 24B and the other end of each of said auxiliary cables 21A, 21B must be connected to the respective auxiliary eyes 4A, 4B. It should be mentioned that the same may occur in the case of the anchor 55.

After breakage of the auxiliary restraining means 11A, 11B, at the time of the change in the angle of attack of the anchor 45, 55, the two sets formed by the connection of the front installation cables 23A, 238 to the extensions of front installation cables 24A, 24B will form the two front mooring cables of the anchor 45, 55, as described above, and will give rise to the breakage of the respective auxiliary cables 21A, 21B.

The anchors 25 and 45 of the present invention are more suited to use in the mooring of floating units which have to remain in operation over a lengthy period of time at a specific location, for example stationary production units. Of course, the anchors 35 and 55 are more suited to mooring floating units which undergo frequent changes in operating location such as, for example, drilling floating units. However, the anchors described here may be used for mooring any type of vessel, the decision regarding the type to be used remaining at the discretion of the user.

It should be mentioned here that, in the anchor embodiments 35 and 55 the orientation and removal line 13 functions only as an orientation line at the time of the descent of the anchor as far as the seabed. However, in the event of there being a failure in the removal of the anchor by means of the mooring line 6, the orientation and removal line 13 may also be used to effect removal of the anchor in question.

It should also be mentioned that despite the fact that a description has been given here of the burial of anchors using the actual mooring line 6, there is nothing to prevent the anchor being buried by means of any anchor-pulling line, for subsequent installation of the mooring line. However, such an action would cancel out one of the major advantages of the present invention, i.e. the possibility of burying the anchor by means of the mooring line itself, thereby markedly reducing the cost of installation of the mooring system.

The anchors described above provide enormous operational advantages in comparison with the anchors of the current state of the art, consequently reducing the costs inherent in burial operations, actual operation and also withdrawal of vertical-load dragging anchors.

Although the present invention has been described here in relation to the preferred embodiments thereof, modifications and substitutions may be made without thereby departing from the spirit and the scope of the invention, which is limited only by the content of the appended claims.

What is claimed is:

1. An anchor which comprises:

an anchor fluke member, a pair of front eyes and a pair of rear eyes rigidly connected to said anchor fluke member;

a pair of front mooring cables and a pair of rear mooring cables which are all substantially of equal length and whose lower ends are firmly connected to said front eyes and said rear eyes, respectively, said front mooring cables and said rear mooring cables bring joined at their upper ends by a joining means so as to form an anchor bobstay, said bobstay being connected to an anchor pulling line;

a removal eye to which is connected an end of an orientation and removal cable;

an anchor pulling line connected to said bobstay; wherein said joining means comprises a connecting plate which is provided with a plurality of connecting points;

upper ends of said front mooring cables and said rear mooring cables are firmly connected to respective connecting points at said plurality of connecting points of said connecting plate;

said anchor pulling line is firmly connected to a top of said connecting plate at its respective connecting point of said plurality of connecting points;

said front eyes are provided with front connection points and with rear connection points, and the lower ends of said front mooring cables are firmly connected, respectively, to said rear connection points of said front eyes;

a pair of front installation cables having lengths which are shorter than the lengths of said front mooring cables and then the lengths of said rear mooring cables, in order to form a required angle of attack of said anchor;

upper ends of said front installation cables are connected to said plurality of connecting points of said connecting plate and the lower ends of said front installation cables are releasably connected to said front connection points of said front eyes, respectively; and wherein auxiliary restraining means are provided, located respectively at said front connection points to prevent said lower ends of said front installation cables being disconnected from their respective connection points during handling of said anchor, it being possible for said auxiliary restraining means to be broken by said lower ends of said front installation cables by means of a movement of said front installation cables as a consequence of a movement of said anchor installation cable in an opposite direction from a burial direction of said anchor, so as to make it possible for said anchor then to be pulled with an angle of attack of substantially 90°, as occurs in operation of said anchor.

2. An anchor according to claim 1, wherein it further comprises:

a pair of auxiliary eyes which are rigidly connected to said anchor fluke member;

a pair of auxiliary cables which have one of their ends firmly connected to said auxiliary eyes, respectively; and wherein a free end of each said auxiliary cable is releasably attached to a predetermined point of its respective front mooring cable in order to keep each of these front mooring cables stretched out and in line with said front installation cables and with said rear mooring cables so as not to generate greater resistance to an advance of said anchor in an ocean floor at the time of its burial.

3. An anchor according to claim 1, wherein said anchor installation cable is a mooring line.

4. An anchor according to claim 1, wherein the length of said front installation cables determines an angle of attack for burial of said anchor.

5. An anchor according to claim 2, wherein said anchor installation cable is a mooring line.

6. An anchor according to claim 2, wherein the length of said front installation cables determines an angle of attack for burial of said anchor.

7. An anchor according to claim 3, wherein the length of said front installation cables determines an angle of attack for burial of said anchor.

8. An anchor according to claim 5, wherein the length of said front installation cables determines an angle of attack for burial of said anchor.

9. An anchor according to claim 1, wherein said front eyes being provided with said rear connection points having auxiliary restraining means intended to keep the lower ends of said front mooring cables which are respectively secured to said rear connection points, said auxiliary restraining means being able to be broken by said lower ends of said front mooring cables by means of a movement of said front mooring cables as a consequence of a movement of said anchor installation cable in an opposite direction from a burial direction of said anchor.

10. An anchor according to claim 9, wherein said anchor installation cable is a mooring line.

11. An anchor according to claim 9, wherein the length of said front installation cables determines a angle of attack for burial of said anchor.

12. An anchor according to claim 11, wherein said anchor installation cable is a mooring line.

13. An anchor according to claim 1, wherein said front mooring cables are formed by two segments, namely a front installation cable and an extension of said front installation cable;

said front installation cables are substantially of equal length and their lower ends are releasably connected to said front connection points, respectively;

said extensions of said front installation cables are substantially of the same length and have one of their ends firmly connected to said rear connection points;

the other ends of said extensions of said front installation cables are firmly connected to the lower ends of said front installation cables;

the upper ends of said front installation cables and the upper ends of said rear mooring cables are firmly connected to respective connecting points of said plurality of connecting points of said connecting plate;

said anchor pulling line is firmly connected to a top of said connecting plate at its said respective connecting point;

auxiliary restraining means are provided, located, respectively, at said front connection points to prevent said ends of said front installation cables from being disconnected from their respective connection points during handling of said anchor, it being possible for said auxiliary restraining means to be broken by the ends of said front installation cables by means of a movement of these front installation cables as a consequence of a movement of said anchor installation cable in an opposite direction from a burial direction of said anchor so as to make it possible for said anchor then to be able to be pulled with an angle of attack of substantially 90°, as in operation of said anchor;

the length of said rear mooring cables is substantially equal to a sum of the length of each said front installation cable connected to its respective extension of said front installation cable.

14. An anchor according to claim 13, wherein said anchor installation cable is a mooring line.

15. An anchor according to claim 13, wherein the length of said front installation cables determines an angle of attack for burial of said anchor.

16. An anchor according to claim 15, wherein said anchor installation cable is a mooring line.

17. An anchor according to claim 13, wherein it further comprises:

a pair of auxiliary eyes rigidly secured to said anchor fluke member;

a pair of auxiliary cables which have one of their ends releasably attached to a specific point of their respective extension of said front installation cable and whose other end of each of said auxiliary cables is connected to its respective auxiliary eye so as to keep said extensions of said front installation cables stretched out so as not to generate greater resistance to an advance of said anchor in an ocean floor at the time of its burial; and wherein, after breakage of said auxiliary restraining means at the time of a change in an angle of attack of said anchor, two assemblies formed by a connection of each said front installation cable to its respective extension of said front installation cable are able to cause a breakage of each respective auxiliary cables.

18. An anchor according to claim 17, wherein said anchor installation cable is a mooring line.

19. An anchor according to claim 17, wherein the length of said front installation cables determines an angle of attack for burial of said anchor.

20. An anchor according to claim 19, wherein said anchor installation cable is a mooring line.

21. An anchor according to claim 13, wherein said front eyes are provided with rear connection points which are, respectively, connected to the lower ends of said extensions of front installation cables, said rear connection points being provided with auxiliary restraining means which are intended to keep said lower ends of said extensions of said front installation cables secured to said rear connection points until said anchor has been withdrawn by said anchor installation cable.

22. An anchor according to claim 21, wherein said anchor installation cable is a mooring line.

23. An anchor according to claim 21, wherein the length of said front installation cables determines an angle of attack for burial of said anchor.

24. An anchor according to claim 23, wherein said anchor installation cable is a mooring line.

25. An anchor according to claim 21, wherein it further comprises:

a pair of auxiliary eyes rigidly secured to said anchor fluke member:

a pair of auxiliary cables each having one of its ends releasably attached to a specific point of their respective extension of said front installation cable and its other end connected to said auxiliary eyes, respectively, so as to keep said extensions of front installation cables stretched out so as not to generate greater resistance to an advance of said anchor in an ocean floor at the time of its burial; and wherein, after breakage of said auxiliary restraining means at the time of a change in an angle of attack of said anchor, two assemblies formed by a connection of said front installation cables to the extensions of said front installation cable provoke a breakage of said respective auxiliary cables.

26. An anchor according to claim 25, wherein said anchor installation cable is a mooring line.

27. An anchor according to claim 25, wherein the length of said front installation cables determines an angle of attack for burial of said anchor.

28. An anchor according to claim 27, wherein said anchor installation cable is a mooring line.

29. A method for burying an anchor, with substantially vertical loading, comprising the steps of:

initially, using an anchor pulling line and an anchor handling boat to drop, as far as a seabed, at a predetermined spot, an orientation and removal line and an anchor, said anchor pulling line being connected to an interconnecting means, to which are also connected the upper ends of cables forming an anchor bobstay; and then pulling said anchor by said anchor handling boat in a predetermined direction, by means of said anchor pulling line, until said anchor has reached a burial depth preestablished in a mooring plan; wherein said bobstay comprises rear mooring cables, the lower ends of which are respectively connected to rear eyes rigidly linked to an anchor fluke member of said anchor, and front installation cables, the lower ends of which are respectively connected to front connection points of front eyes rigidly linked to said anchor fluke member of said anchor, the length of said front installation cable being substantially less than the length of said rear mooring cables; and using said anchor handling boat to then pull said anchor pulling line in an opposite direction from a burial direction of said anchor until the lower ends of said front installation cables break auxiliary restraining means which exist on said front connection points, whereby said front installation cables will no longer be attached to their respective front connection points and a movement of said front installation cables in an opposite direction from a burial direction of said anchor, as a consequence of said anchor pulling line being pulled in an opposite direction from that of burial of said anchor, will release them from their connection to their respective front connection points, whereby front mooring cables become part of said bobstay, said front mooring cables having its lower ends respectively connected to rear connecting points located at said front eyes, and its upper ends connected to said joining means, the length of said front mooring cables being substantially equal to the length of said rear mooring cables, and consequently an angle of attack of said anchoring pulling line with respect to said anchor fluke member of said anchor changes to 90°, in which position a maximum mooring efficiency is obtained and said anchor will be ready to be subsequently connected to a mooring line.

30. A method according to claim 29, wherein said anchor pulling line is a mooring line.

31. A method according to claim 29, wherein it further comprises the steps of:

initially moving said mooring line in an opposite direction from a burial direction of said anchor, in order to remove said anchor;

whereby the lower ends of said front mooring cables of said anchor, which are connected to respective rear connection points located, respectively, on front eyes, are forced backwards, in an opposite direction from said burial direction of said anchor, consequently breaking auxiliary restraining means located on said rear connection points thereby releasing the ends of said front mooring cables; whereby it will then be possible for said anchor to be removed by means of said rear mooring cables which exist on it, as these rear mooring cables will remain connected to their respective rear eyes and, with a continuation of said movement of said anchor pulling line in an opposite direction from said burial direction of said anchor, said anchor pulling line will pull said rear mooring cables in an opposite direction from said burial direction of said anchor and, consequently, said anchor may be withdrawn with an angle of attack of 0°, i.e. a removal force will be minimal.

32. A method according to claim 31, wherein said anchor pulling line is a mooring line.

33. A method according to claim 29, wherein said front installation cables each have its lower end connected to an end of a respective extension of a front installation cable, the other end of which is connected to said rear connecting points of said front eyes so as to break said auxiliary restraining means and cause said front installation cable to no longer be attached to its respective front connection point, and the length of rear mooring cables of said anchor will change to be substantially equal to a sum of said respective front installation cables connected to their respective extensions of front installation cables forming said front mooring cables of said anchor, and said anchor will be ready to be subsequently connected to a mooring line.

34. A method according to claim 33, wherein said anchor pulling line is a mooring line.

35. A method according to claim 33, wherein it further comprises the steps of:

initially moving said mooring line in an opposite direction from a burial direction of said anchor, in order to remove said anchor;

the lower ends of said front mooring cables of said anchor which are connected to respective rear connection points located, respectively, on said front eye will be forced backwards in an opposite direction from said burial direction of said anchor, thereby breaking restraining means located on said rear connection point, thereby releasing an end of said front mooring cable; and removing said anchor by means of said rear mooring cables which exist on it, as these rear mooring cables remain connected to their respective rear eyes and, with a continuation of said movement of said mooring line in an opposite direction from said burial direction of said anchor, causing said mooring line to pull said rear mooring cables in an opposite direction from a burial direction of said anchor and, consequently, withdraw said anchor with an angle of attack of 0°.

36. A method according to claim 35, wherein said anchor pulling line is a mooring line.

* * * * *